US010045563B2

(12) United States Patent
Li et al.

(10) Patent No.: US 10,045,563 B2
(45) Date of Patent: Aug. 14, 2018

(54) ATOMIZER, POWER SUPPLY, AND ELECTRONIC CIGARETTE HAVING SAME

(71) Applicant: Shenzhen First Union Technology Co., Ltd., Shenzhen, Guangdong Province (CN)

(72) Inventors: Yonghai Li, Shenzhen (CN); Zhongli Xu, Shenzhen (CN); Xianming Wang, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 468 days.

(21) Appl. No.: 14/714,213

(22) Filed: May 15, 2015

(65) Prior Publication Data

US 2015/0327597 A1 Nov. 19, 2015

(30) Foreign Application Priority Data

May 15, 2014 (CN) ..... 2014 2 0247995

(51) Int. Cl.

| | |
|---|---|
| ***A24F 13/00*** | (2006.01) |
| ***A24F 47/00*** | (2006.01) |
| ***H05B 3/03*** | (2006.01) |
| ***H01R 13/502*** | (2006.01) |

(52) U.S. Cl.

CPC ..... *A24F 47/008* (2013.01); *H01R 13/502* (2013.01); *H05B 3/03* (2013.01)

(58) Field of Classification Search

CPC ..... A24F 47/008; A24F 29/00; A24F 47/004; H01R 13/502; H01R 13/506

See application file for complete search history.

(56) References Cited

U.S. PATENT DOCUMENTS

| | | | | |
|---|---|---|---|---|
| 8,678,012 | B2 * | 3/2014 | Li | A24F 47/008 128/202.21 |
| 2011/0094523 | A1 * | 4/2011 | Thorens | A24F 47/008 131/194 |
| 2012/0273589 | A1 * | 11/2012 | Hon | A24F 47/002 239/128 |
| 2012/0279512 | A1 * | 11/2012 | Hon | A24F 47/008 131/329 |
| 2013/0056013 | A1 * | 3/2013 | Terry | A24F 47/008 131/328 |

(Continued)

*Primary Examiner* — Thanh Tam Le

(74) *Attorney, Agent, or Firm* — Cheng-Ju Chiang

(57) ABSTRACT

An exemplary electronic cigarette includes an atomizer and a power supply. The atomizer includes one of a first connector and a second connector, and the power supply includes the other of a first connector and a second connector. The first connector includes a cylindrical plug. The plug has a recessed portion in a side surface thereof. The second connector includes a holder, a movable component, and a force exerting component. The holder is configured for receiving the plug. The movable component is movable arranged on a sidewall of the holder. The force exerting component is configured for exerting an elastic force on the movable component. The movable component is configured for ejecting from the sidewall to engage in the recessed portion when the movable component ejecting from the sidewall, and for retracting relative to the sidewall when the plug is inserted into the holder.

11 Claims, 5 Drawing Sheets

(56) References Cited

U.S. PATENT DOCUMENTS

| | | | | |
|---|---|---|---|---|
| 2013/0192622 | A1* | 8/2013 | Tucker | H01C 17/00 131/329 |
| 2013/0228191 | A1* | 9/2013 | Newton | A24F 47/008 131/329 |
| 2014/0060524 | A1* | 3/2014 | Liu | A24F 47/008 128/200.14 |
| 2014/0182610 | A1* | 7/2014 | Liu | A24F 47/008 131/329 |
| 2014/0182612 | A1* | 7/2014 | Chen | A24F 47/008 131/329 |
| 2014/0366898 | A1* | 12/2014 | Monsees | A24F 47/008 131/329 |
| 2015/0013701 | A1* | 1/2015 | Liu | A24F 47/008 131/329 |
| 2015/0053218 | A1* | 2/2015 | Liu | A61M 11/042 131/329 |

* cited by examiner

ATOMIZER, POWER SUPPLY, AND ELECTRONIC CIGARETTE HAVING SAME

TECHNICAL FIELD

The present invention relates to electronic cigarettes, and particularly to an atomizer, a power supply, and an electronic cigarette using same.

BACKGROUND ART

A typical electronic cigarette includes an atomizer and a power supply. Usually, the atomizer and the power supply are coupled threadedly. However, it is inconvenient to assemble or detach the atomizer and the power supply, since the atomizer needs to be rotated relative to the power supply many turns.

What are needed, therefore, are an atomizer, a power supply, and an electronic cigarette using same, which can overcome the above shortcomings.

SUMMARY

An exemplary electronic cigarette includes an atomizer and a power supply.

The atomizer includes one of a first connector and a second connector, and the power supply includes the other of a first connector and a second connector. The first connector includes a cylindrical plug. The plug has a recessed portion in a side surface thereof. The second connector includes a holder, a movable component, and a force exerting component. The holder is configured for receiving the plug. The movable component is movable arranged on a sidewall of the holder. The force exerting component is configured for exerting an elastic force on the movable component. The movable component is configured for ejecting from the sidewall to engage in the recessed portion when the movable component ejecting from the sidewall, and for retracting relative to the sidewall when the plug is inserted into the holder.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
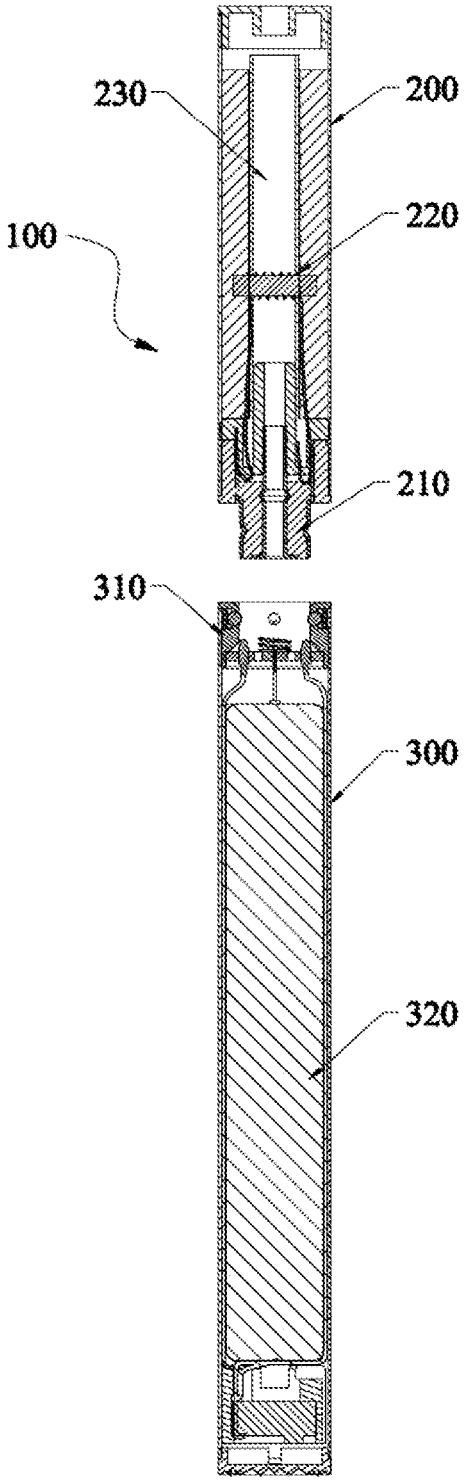
FIG. 1 is a cross-sectional view of an electronic cigarette when not assembled according to a first embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Several definitions that apply throughout this disclosure will now be presented.

The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Figure 2:
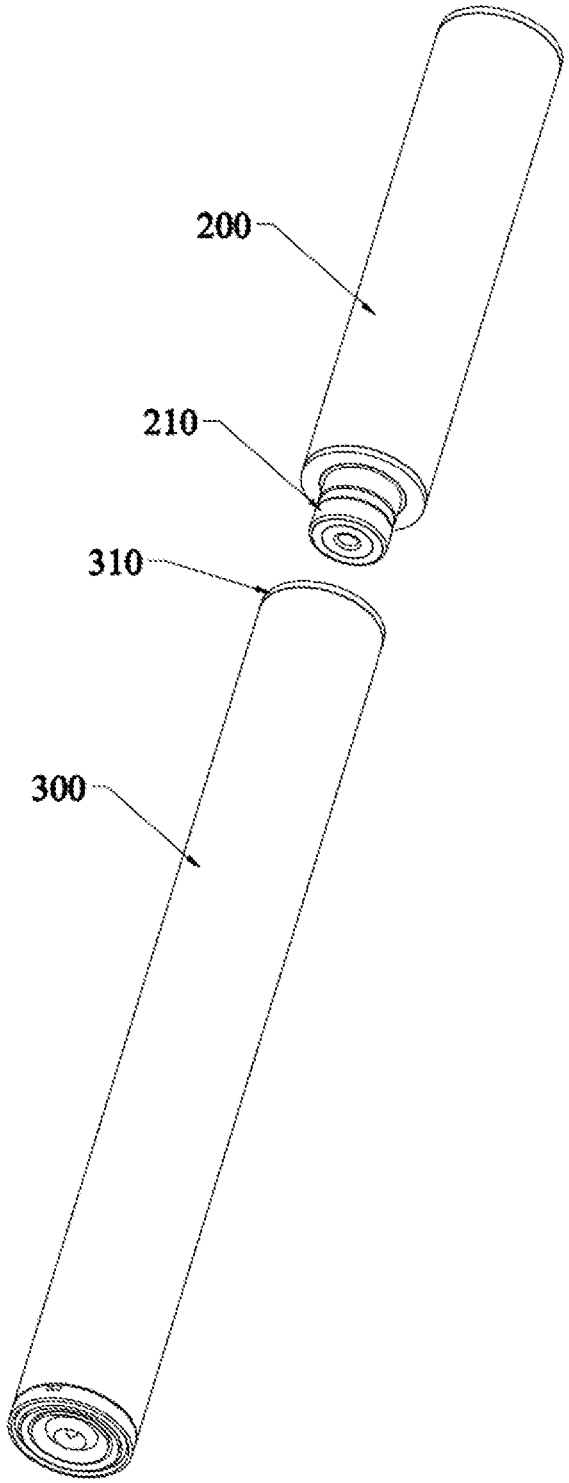
FIG. 2 is a perspective view of the electronic cigarette of FIG. 1 when not assembled.

Referring to FIGS. 1-2, an electronic cigarette 100 includes an atomizer 200 and a power supply 300. The atomizer 200 is configured (i.e., structured and arranged) for heating tobacco liquid to form aerosol. The power supply 300 is configured for providing the atomizer 200 power. The atomizer 200 includes a first connector 210, and the power supply 300 includes a second connector 310. The first connector 210 is adapted for inserting into the second connector 310, and is thus coupled to the second connector 310. It is to be understood that in other embodiments, the first connector 210 may be arranged in the power supply 300, and correspondingly, the second connector 310 may be provided in the atomizer 200.

Figure 3:
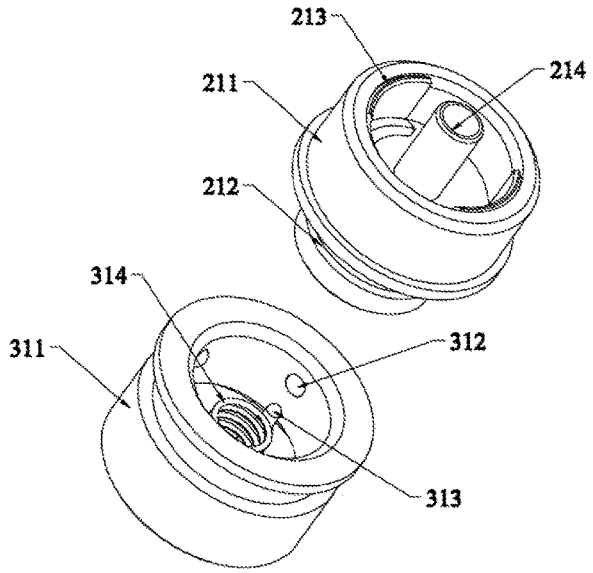
FIG. 3 is a perspective view of a first connector and a second connector of the electronic cigarette of FIG. 1 when not assembled.
Figure 4:
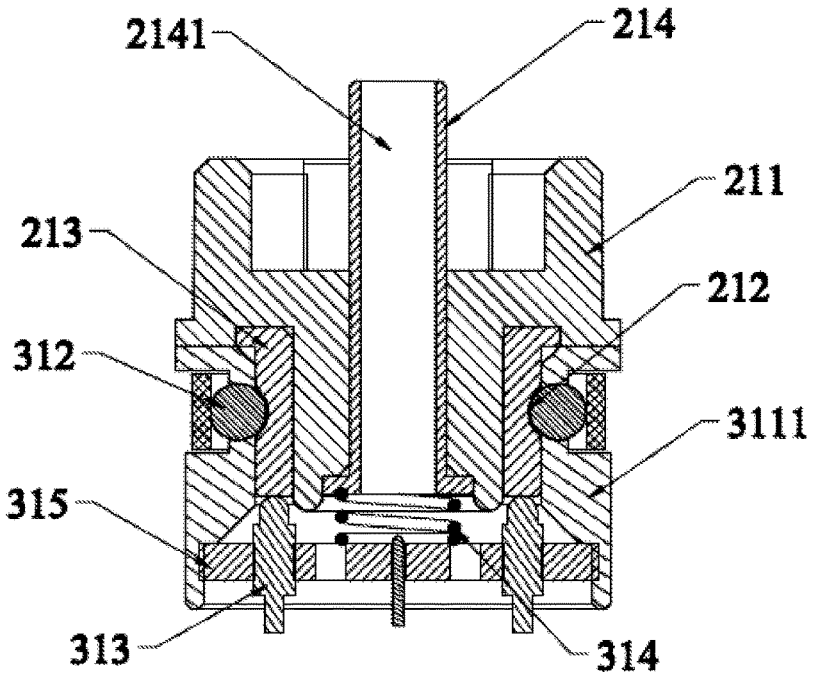
FIG. 4 is a cross-sectional view of the first connector and the second connector of the electronic cigarette of FIG. 1 when assembled.

Referring to FIGS. 3-4, the first connector 210 includes a cylindrical plug 211. The plug 211 has a recessed portion 212 in a side surface thereof. The second connector 310 includes a holder 311, a movable component, and a force exerting component. The holder 311 is configured for receiving the plug 211. The movable component is movably received in a sidewall 3111 of the holder 311. The force exerting component is configured for exerting elastic force on the movable component. In the present embodiment, the movable component includes a plurality of steel balls 312*a*. The steel balls 312*a* are capable of ejecting from the sidewall 3111 and retracting relative to the sidewall 3111. When the steel balls 312*a* retract to avoid the plug 211, the plug 211 can be inserted into the holder 311 smoothly; when the steel balls 312*a* eject to insert into the recessed portion 212, the atomizer 200 is engaged with the power supply 300.

Figure 5:
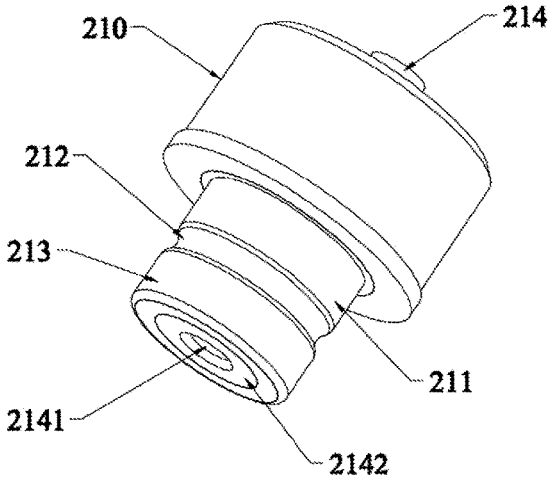
FIG. 5 is a perspective view of the first connector of FIG. 1.

Referring to FIG. 5, the first connector 210 further includes an outer electrode 213, and an inner electrode 214. The inner electrode 214 is arranged in the outer electrode, and is insulated from the outer electrode 213. The atomizer 200 includes a heating element 220 inside. One end of the heating element 220 is connected to the outer electrode 213, and an opposite end of the heating element 220 is connected to the inner electrode 214.

Figure 6:
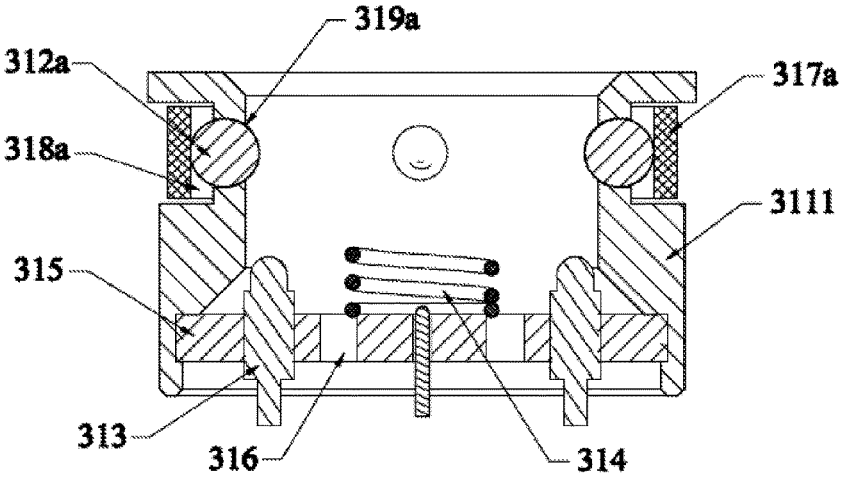
FIG. 6 is a cross-sectional view of the second connector of the electronic cigarette of FIG. 1.

Also referring to FIG. 1 and FIG. 6, the power supply 300 includes a battery 320 inside. The holder 311 includes a first terminal 313 and a second terminal 314, both of which are connected to the battery 320 respectively. When the steel balls 312*a* are engaged in the recessed portion 212, the first terminal 313 is electrically connected with the outer electrode 213, and the second terminal 314 is electrically connected with the inner electrode 214. In this way, the atomizer 200 and the power supply 300 are mechanically and electrically connected via the first and the second connectors 210, 310, thus simplifying structure of the electronic cigarette.

Further, the atomizer 200 defines an air passage 230. The inner electrode 214 defines a central hole 2141 communicating with the air passage 230. Air can enter the air passage 230 through the central hole 2141.

The inner electrode 214 includes a flange 2142 (as shown in FIG. 5) at one end. An end surface of the flange 2142 is coplanar with an end surface of the plug 211. Accordingly, the inner electrode 214 is in reliable and stable contact with the second terminal 314, when the atomizer 200 is coupled to the power supply 300.

Referring to FIG. 6, the first terminal 313 is designed as elastic structure. The first terminal 313 is in elastic contact with the outer electrode 213. Accordingly, a connection problem between the first terminal 313 and the outer electrode 213, which may be caused by size error, is overcome. Likewise, the second terminal 314 is in elastic contact with the inner electrode 214. In the present embodiment, the first terminal 313 includes a first pin capable of stretching and shrinking, and the second terminal 314 includes a spring.

Further, the first and the second terminals 313, 314 are both fixed on a plate 315. The plate 315 is engaged with the holder 311 by interference fit. The plate 315 defines a plurality of air holes 316. Air enters the power supply 300 from an end of the power supply 300, passes through the air holes 316 and the central hole 2141, and then reaches the atomizer 200.

Further, in the second connector 310, the force exerting component includes an elastic ring 317*a*, and the sidewall 3111 of the holder 311 defines an annular groove 318*a*. The elastic ring 317*a* is engaged in the annular groove 318*a*. The sidewall 3111 further defines a plurality of mounting holes 319*a*. The mounting holes 319*a* extend through the sidewall 3111, and communicate with the annular groove 318*a*. The steel balls 312*a* are engaged in corresponding mounting holes 319*a*. The elastic ring 317*a* is configured for exerting an elastic force on the steel balls 312*a*, so that the steel balls 312*a* are tightly engaged in the mounting holes 319*a*, and a part of each steel ball 312*a* protrudes from the sidewall 3111. It is to be understood that a diameter of the mounting hole 319*a* should be less than that of the steel ball 312*a*, thus preventing the steel ball 312*a* from falling.

In use, the atomizer 200 is inserted into the power supply 300 in such a manner that the first connector 210 is engaged with the second connector 310. Therefore, it is very convenient to assemble the electronic cigarette 100.

Figure 7:
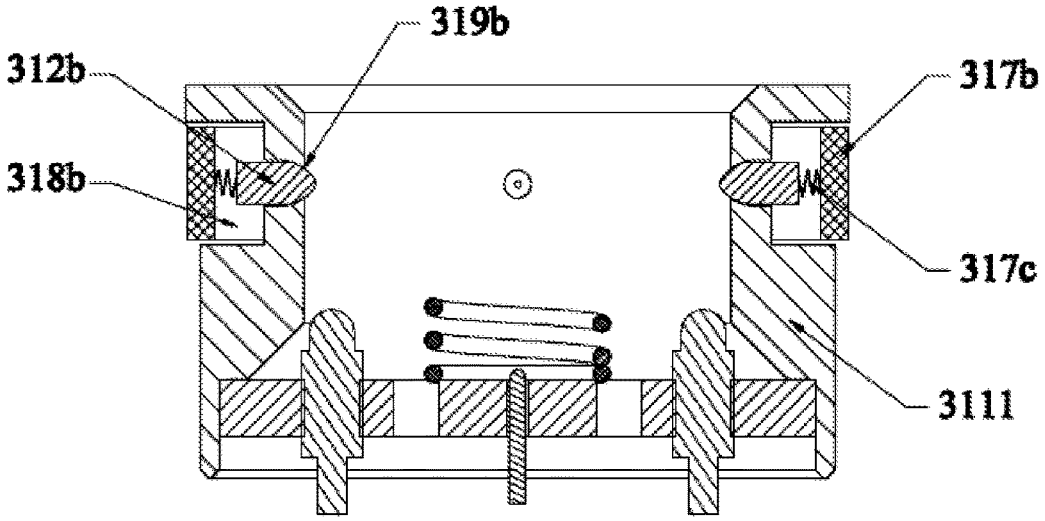
FIG. 7 is a cross-sectional view of another second connector according to a second embodiment.

Referring to FIG. 7, a second connector 310 according to a second embodiment is shown. In the present embodiment, the force exerting component of the second connector 310 includes a fixed ring 317*b* and a plurality of springs 317*c*. The fixed ring 317*b* and the springs 317*c* replace the above elastic ring 317*a* of the first embodiment. The movable component includes a plurality of second pins 312*b*. Each second pin 312*b* includes a front end and a base. The front end is capable of protruding from the sidewall 3111, while the base cannot protrude from the sidewall 3111. The sidewall 3111 defines an annular groove 318*b* and a plurality of mounting holes 319*b*. The mounting holes 319*b* extend through the sidewall 3111, and communicate with the annular groove 318*b*. The fixed ring 317*b* is engaged in the annular groove 318*b*. The second pins 312*b* are engaged in corresponding mounting holes 319*b*. Each spring 317*c* is arranged between the fixed ring 317*b* and a respective second pin 312*b*. The springs 317*c* are configured for exerting an elastic force on a corresponding second pin 312*b*, so that the second pins 312*b* are tightly engaged in the mounting holes 319*b*. It is to be understood that a diameter of the mounting hole 319*a* should be larger than that of the front end of the second pin 312*b*, and the diameter of the mounting hole 319*a* should be less than that of the base of the second pin 312*b*, thus preventing the second pin 312*b* from falling out of the mounting hole 319*a*.

The recessed portion 212 is arc-shaped in cross-section, and the front end of each second pin 312*b* is also arc-shaped in cross-section. In this way, the front end of each second pin 312*b* and the recessed portion 212 are in surface contact. Accordingly, the connection between the atomizer 200 and the power supply 300 is more stable.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. An electronic cigarette comprising:

an atomizer comprising a selective one out of a first connector and a second connector; and a power supply comprising the rest one of a first connector and a second connector;

wherein the first connector comprises a cylindrical plug comprising a central extension axis, the plug having a recessed portion formed at a side surface of the plug facing away from the extension axis; and the second connector comprises a holder, a movable component, and a force exerting component; the holder is configured for receiving the plug therein along the extension axis of the plug, the movable component is movable arranged on a sidewall of the holder in order to move along a direction perpendicular to the extension axis of the plug, the force exerting component is configured for exerting an elastic force on the movable component to urge the movable component against the sidewall of the holder along the direction; the movable component is configured for ejecting from the sidewall along the direction to engage in the recessed portion when the plug is received in the holder for fixing the plug with the holder, and for retracting relative to the sidewall when the plug moves into or out of the holder.

2. The electronic cigarette of claim 1, wherein the first connector further comprises an outer electrode and an inner electrode, the inner electrode is arranged in the outer electrode, and is insulated from the outer electrode; the atomizer comprises a heating element, one end of the heating element is connected to the outer electrode, and an opposite end of the heating element is connected to the inner electrode.

3. The electronic cigarette of claim 2, wherein the first connector is the selective one out of the first connector and the second connector in the atomizer, a power supply comprises the second connector; the power supply comprises a battery, the holder comprises a first terminal and a second terminal, both of the first terminal and the second terminal are connected to the battery respectively, when the movable component is engaged in the recessed portion, the first terminal is electrically connected to the outer electrode, and the second terminal is electrically connected to the inner electrode.

4. The electronic cigarette of claim 3, wherein the atomizer defines an air passage therethrough, and the inner electrode defines a central hole communicating the air passage.

5. The electronic cigarette of claim 3, wherein the first terminal is in elastic contact with the outer electrode, and/or the second terminal is in elastic contact with the inner electrode.

6. The electronic cigarette of claim 4, wherein the inner electrode includes a flange at one end, and an end surface of the flange is coplanar with an end surface of the plug.

7. The electronic cigarette of claim 4, wherein the holder further comprises a plate, the first and the second terminals are both fixed on the plate, and the plate defines a plurality of air holes.

8. The electronic cigarette of claim 1, wherein the force exerting component comprises an elastic ring, and the sidewall of the holder defines an annular groove, the movable component comprises a plurality of steel balls, the sidewall further defines a plurality of mounting holes, the mounting holes extend through the sidewall, and communicate with the annular groove, the steel balls are engaged in corresponding mounting holes, the elastic ring is engaged in the annular groove, the elastic ring is configured for exerting an elastic force on the steel balls, so that the steel balls are tightly engaged in the mounting holes, and a part of each steel ball protrudes from the sidewall.

9. The electronic cigarette of claim 1, wherein the force exerting component comprises a fixed ring and a plurality of springs, the sidewall defines an annular groove and a plurality of mounting holes, the movable component has a plurality of second pins, the mounting holes extend through the sidewall, and communicate with the annular groove, the fixed ring is engaged in the annular groove, the second pins are engaged in corresponding mounting holes, each spring is arranged between the fixed ring and a respective second pin, the springs are configured for exerting an elastic force on a corresponding second pin, so that the second pins are tightly engaged in the mounting holes, and ends of the second pins protrude from each mounting hole.

10. The electronic cigarette of claim 1, wherein the recessed portion is arc-shaped in cross-section.

11. An electronic cigarette comprising:

an atomizer comprising a selective one out of a first connector and a second connector; and a power supply comprising the rest one of a first connector and a second connector;

wherein the first connector comprises a cylindrical plug, the plug having a recessed portion in a side surface thereof; and the second connector comprises a holder, a movable component, and a force exerting component; the holder is configured for receiving the plug, the movable component is movable arranged on a sidewall of the holder, the force exerting component is configured for exerting an elastic force on the movable component; the movable component is configured for ejecting from the sidewall to engage in the recessed portion when the movable component ejecting from the sidewall, and for retracting relative to the sidewall when the plug is inserted into the holder;

wherein the force exerting component comprises an elastic ring, and the sidewall of the holder defines an annular groove, the movable component comprises a plurality of steel balls, the sidewall further defines a plurality of mounting holes, the mounting holes extend through the sidewall, and communicate with the annular groove, the steel balls are engaged in corresponding mounting holes, the elastic ring is engaged in the annular groove, the elastic ring is configured for exerting an elastic force on the steel balls, so that the steel balls are tightly engaged in the mounting holes, and a part of each steel ball protrudes from the sidewall.

* * * * *